United States Patent [19]

Pugh et al.

[11] Patent Number: 5,072,147

[45] Date of Patent: Dec. 10, 1991

[54] LOW SAG TUNGSTEN FILAMENT HAVING AN ELONGATED LEAD INTERLOCKING GRAIN STRUCTURE AND ITS USE IN LAMPS

[75] Inventors: John W. Pugh, Gates Mills; Donald L. Bly, Chagrin Falls, both of Ohio

[73] Assignee: General Electric Company, Schenectady, N.Y.

[21] Appl. No.: 521,201

[22] Filed: May 9, 1990

[51] Int. Cl.[5] ..... H01K 1/02

[52] U.S. Cl. ..... 313/341; 313/578

[58] Field of Search ..... 313/578, 341; 252/515

[56] References Cited

U.S. PATENT DOCUMENTS

| | | | |
|---|---|---|---|
| 3,297,989 | 12/1975 | Koo | 29/182.5 |
| 3,975,219 | 8/1976 | Allen et al. | 148/11.5 P |
| 4,012,659 | 3/1977 | Passmore et al. | 313/344 |
| 4,020,383 | 4/1977 | Labadini et al. | 313/344 |
| 4,291,444 | 9/1981 | McCarty et al. | 29/25.4 |
| 4,296,352 | 10/1981 | Berlic et al. | 313/315 |
| 4,440,729 | 4/1984 | Jonsson | 423/55 |
| 4,863,527 | 9/1989 | Schaeffer et al. | 148/11.5 F |

OTHER PUBLICATIONS

Pugh and McWhorter, "An Elastic Recovery Test for Recrystallization", Metall. Trans, v. 20A, pp. 1885–1887 (9/89).

Tungsten, pp. 136–137 (1952 Chapman & Hall, Ltd., London).

*Primary Examiner*—Donald J. Yusko
*Assistant Examiner*—John E. Giust
*Attorney, Agent, or Firm*—Edward M. Corcoran; Stanley C. Corwin; Fred Jacob

[57] ABSTRACT

Improved tungsten coil filaments having good sag resistance and useful in double ended, high intensity and energy efficient tungsten halogen lamps having an IR reflecting filter on the filament chamber. These coil filaments have a microstructure which is a large, elongated and interlocking grain structure produced by a high temperature heat treatment process.

64 Claims, 5 Drawing Sheets

Fig. 2(a)
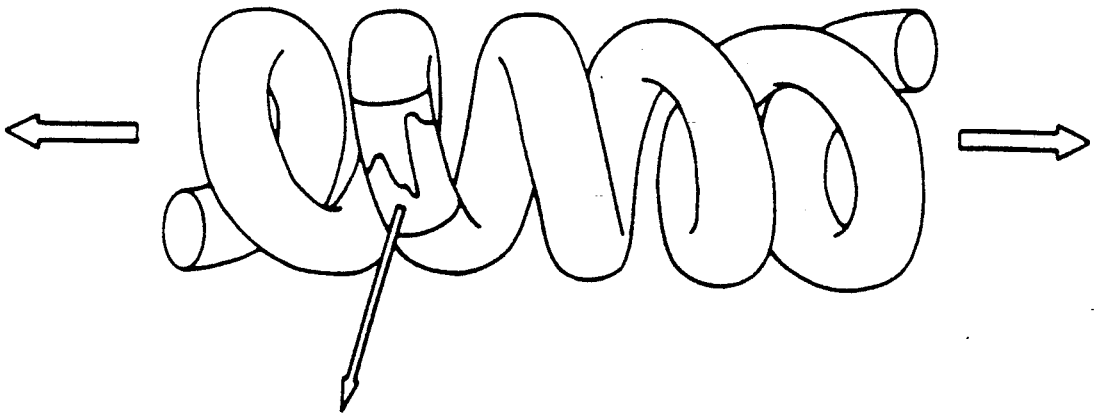
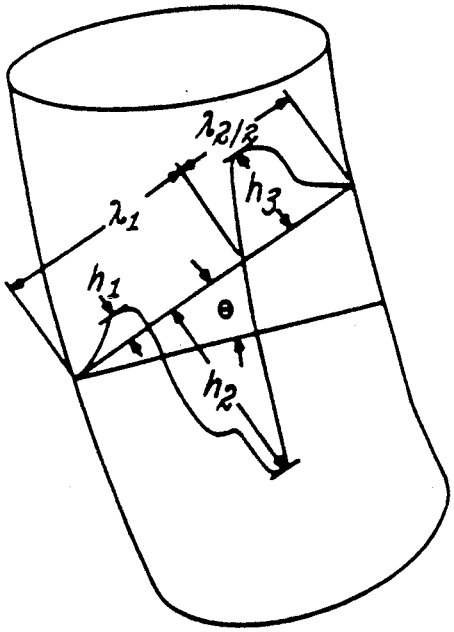
Fig. 2(b)

LOW SAG TUNGSTEN FILAMENT HAVING AN ELONGATED LEAD INTERLOCKING GRAIN STRUCTURE AND ITS USE IN LAMPS

BACKGROUND OF THE INVENTION

1. Field of the Invention

This invention relates to an improved, sag resistant tungsten filament and its use in lamps. More particularly, this invention relates to a tungsten filament being at least about 85% recrystallized and having a microstructure comprising a large, elongated and interlocking grain structure, a method for producing same and its use in electric lamps.

2. Background of the Disclosure

The use of tungsten filaments in electric lamps, such as incandescent lamps, is well known and old to those skilled in the art. The efficiency or efficacy as well as the light output and color rendering ability of an incandescent lamp is very much dependent on the temperature at which the filament operates. The filament temperature also determines the quality of the emitted light. Generally, the more efficient incandescent lamps, such as tungsten-halogen lamps, employ filaments in the form of coils or helixes and more particularly coiled-coils or double helixes in which the filaments are operated at temperatures of about 2500° C. In stage and studio lamps the filaments are operated at temperatures as high as 2900° C. Higher filament temperatures permit the use of smaller size filaments and concomitantly smaller size lamps for a given light output, which is very desirable in the market place. At the present time, the use of filaments at temperatures above about 2300° C. results in substantial sag which, in turn, distorts the filament coil resulting in an increase in the radiant heat loss, thereby decreasing the luminous efficacy. Sag can also result in shorting across various portions of the coil. Tungsten ingots intended for making tungsten filaments contain a very minor amount of dopants such as potassium, aluminum and silicon. In general, tungsten ingots used to produce wire from which filaments are made consist essentially of from about 99.95 to about 99.99 wt. % of tungsten, along with minor amounts of one or more dopants and impurities.

In fabricating the fine tungsten wire from which filaments are produced, a number of rolling, swaging, wire drawing and annealing steps must be employed. In fabricating filaments from wire, either single coil filaments or coiled-coil filaments in which there is a secondary coil, it is common practice to heat the resulting filament structure at a temperature generally ranging from about 1300°-1600° C. for a period of from about 1 to 10 minutes in order to slightly anneal and stress relieve the so-formed filament. This results in a filament having an essentially unrecrystallized, fibrous microstructure such as is disclosed, for instance, by Smithells on pages 136-137 in his book "Tungsten", published in 1952 by Chapman and Hall, Ltd. (London). Such a fibrous microstructure results in a relatively weak filament having extremely little, if any, sag resistance at the 2000° C. plus temperatures at which filaments are operated. Accordingly, those skilled in the art know that such filaments have to be recrystallized such as is disclosed, for example, by Smithells on pages 136-145 and in U.S. Pat. Nos. 3,927,989 and 4,296,352. Both of these patents disclose that tungsten wire filaments normally recrystallize at a temperature in the general range of between about 1900°-2500° C. The most ideal filament would be one formed of a single crystal of tungsten or one that was recrystallized in a manner so as to form a single crystal of tungsten. Such a filament would have the maximum possible sag resistance and tensile strength. However, at the present time no one has been able to make such a filament and there is still a great need in the art for filaments of improved high temperature sag resistance for use in more compact and efficient lamps.

SUMMARY OF THE INVENTION

The present invention relates to a tungsten filament having a microstructure comprising an elongated and interlocking grain structure which has improved high temperature strength and sag resistance, said grain structure being numerically defined by a grain shape parameter (GSP) having a value of at least about 10 and preferably at least about 15. The value of the grain shape parameter is equal to the value of the grain aspect ratio (GAR) divided by the value of the grain boundary factor (GBF). The GBF and a method for obtaining same is set forth under DETAILED DESCRIPTION below, but basically it relates to the interlocking nature of the boundary of adjacent tungsten crystals or grains in a filament, with relatively straight grain boundaries transverse to the longitudinal axis of the wire being the poorest and resulting in the greatest amount of sag (as Smithells also shows on pages 136 and 137 of his book). The GAR or grain aspect ratio is the average grain or crystal length to diameter ratio. The GSP or grain shape parameter is a figure of merit which combines the properties of the other two parameters. In the present invention, large numerical values for GAR and GSP are desirable, whereas smaller values are preferred in the GBF. In general, as set forth above, the GSP will have a value of at least about 10 and preferably at least about 15. The GAR will have a value of at least about 50 and preferably at least about 100 and the GBF will have a value less than about 15 and preferably less than about 8. The filament of this invention will be at least about 85% recrystallized and preferably at least about 95% recrystallized and may be used at temperatures above 2300° C. with little or no sag. The filaments of this invention may be uncoiled wire, single coil, double and even triple coils, as well as tungsten ribbon. The present invention also relates to lamps containing tungsten filaments having the microstructure of the present invention.

DETAILED DESCRIPTION

Figure 1A:
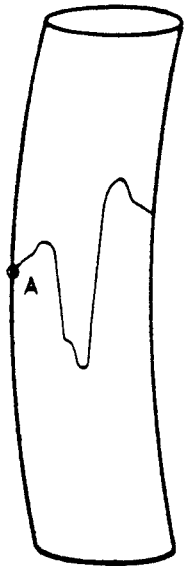
FIGS. 1(*a*), 1(*b*), 1(*c*), 1(*d*) and 2(*a*), 2(*b*) schematically illustrate a portion of a filament according to the present invention illustrating interlocking grains and steps employed in obtaining the GBF.
Figure 1B:
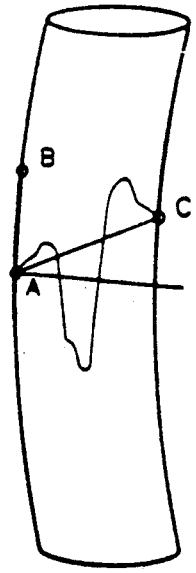
Figure 1C:
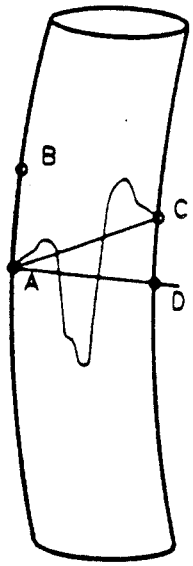
Figure 1D:
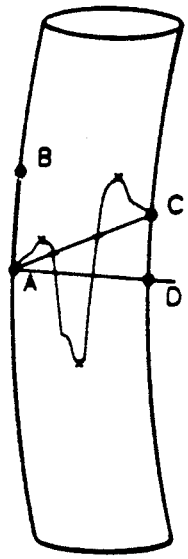

As set forth above, the present invention relates to a tungsten filament having a microstructure which comprises a large, elongated and interlocking grain structure which is defined by a grain shape parameter (GSP) having a value of at least about 10, wherein the GSP is equal to the value of the grain aspect ratio (GAR) divided by the value of the grain boundary factor (GBF). Those skilled in the art know that tungsten filaments are formed from fine tungsten wire having a wire diameter generally less than about 10 mils. A method for evaluating and obtaining these three parameters is set forth below.

In order to ascertain the nature, extent and type of grain boundaries in filaments or wires having the properties under this invention, it is first necessary to thermally etch same by heating at a high temperature in a vacuum or inert atmosphere or in-situ in a lamp for a time sufficient to reveal the grain boundaries. Such thermal etching produces thermal grooving or rounding of grain boundaries which makes them more visible and can generally be done at a relatively wide range of temperatures of from between about 2400°–2700° C. for periods of time, depending upon the temperature and atmosphere, of from about 2 to 24 hours. By way of an illustrative, but non-limiting example, 4 hours at a temperature of 2450° C. in vacuum has been found satisfactory in most cases in the context of the present invention. Alternatively, a filament may be thermally etched in-situ in a lamp by energizing the lamp at its rated voltage for at least about fifty (50) hours. After the filaments or wires have been etched, they are then placed in a field emission scanning electron microscope, such as a Hitachi S-800 field emission scanning electron microscope (SEM) which has a resolution capability of about 20 Å and a depth of field of 100 μm at 1000×.

FIG. 1 schematically represents such an image taken as a section of a schematically depicted coil section of a filament shown in FIG. 2(*a*). FIG. 1 also illustrates the step-by-step procedures taken in the grain shape analyses The measurements are straightforward and can be made directly on the viewing screen (CRT) of an SEM or on photographs taken by the SEM. As illustrated in FIGS. 1(*a*) and 1(*b*), the first step is to find one end of a grain boundary A, then another end of the same grain boundary C, and one edge B of the wire. It is axiomatic, of course, that the diameter of the grain or tungsten crystal is substantially the same as the diameter of the wire or filament. A line AB is drawn which defines the one edge of the wire and another line is drawn normal to AB as shown in FIG. 1(*c*), D being the edge of the other side of the wire and line AD defining the diameter of the wire. Line AC is then drawn in that portion of the grain boundary which crosses AC and the maximums and minimums marked with X's as shown in FIG. 1(*d*). As the filament is continuously scanned, each subsequent grain boundary is analyzed in the same fashion. When the entire length has been scanned, a mean value for GBF may be determined. The grain boundary factor, GBF, is based on the relationship:

$$GBF = \frac{\Sigma \frac{\lambda}{h^2} \cos^2\theta}{N_b}$$

where $N_b$ is the number of grain boundaries measured. The angle, $\theta$, of a grain boundary is determined as shown in FIGS. 1 and 2 as the angle between AC and AD. The wave length, λ, is the reciprocal of the number of waves (boundary undulations) across the diameter of the filament wire. Height, h, or amplitude of a wave is determined as shown in FIG. 2 by reference to the line AC (FIG. 1) connecting the ends of the boundary. In some cases it has been found convenient to measure peak to peak amplitudes and divide by two. Both λ and h are averaged and expressed as fractions of the wire diameter.

The grain aspect ratio, GAR, is determined by means of the equation:

$$GAR = \frac{kN_T}{N_B}$$

where $N_T$ is the number of primary turns examined and $N_B$ is the number of grain boundaries observed. The length of a primary turn divided by the wire diameter is k and is constant for a given filament design.

When the average GBF and GAR have been determined, the grain shape parameter, GSP, is determined for a filament or a population of filaments as:

$$GSP = \frac{GAR}{GBF}$$

These analyses and calculations have also been accomplished by use of a suitable computer program with an image analyzer, such as a Tracor Northern TN8500 Image Analyzer.

The more convoluted or interlocking the grain boundary is, the stronger is the lamp filament. This interlocking feature may be described by two parameters or features. One is the amplitude h of the waviness of the grain boundary. The other is the wavelength λ. Another feature of the grain boundary which can be quantified is the angle $\theta$ it makes with respect to the plane of the cross-section of the wire. In coiled filaments the maximum stress is exerted across the cross-section normal to the longitudinal axis of the wire. Therefore, a greater angle $\theta$ results in lower stress on the boundary. Grain boundary length also increases with increasing angle $\theta$. The GBF combines all these terms as $GBF = (\lambda/h^2)\cos^2\theta$.

In addition to the average quality of a filament's grain boundaries, it is important to determine how many are contributing to filament creep. The parameter chosen to represent this feature is the Grain Aspect Ratio, the average grain length to diameter ratio. This is a familiar, as well as convenient parameter, since it is so frequently associated with high temperature creep performance. In the case of lamp filament wire, where the diameter of a grain is invariably the diameter of the wire, Grain Aspect Ratio is essentially the reciprocal of the number of grain boundaries multiplied by the length evaluated and divided by the wire diameter. The higher the Grain Aspect Ratio, the fewer sliding boundaries can contribute to filament creep and the stronger is the filament.

All of the features described above are combined to provide a figure of merit for recrystallized lamp filament microstructures called the GSP.

Tungsten filaments having the properties according to this invention have been produced by two different processes. One process is a continuous heating process, whereas the other process is a two-stage, discontinuous heating process with cooling to room temperature between each heating stage. In either case the process starts with a coiled filament or filament coil having essentially 0% recrystallization. During the wire-forming and annealing processes employed to produce tungsten filament wire the tungsten wire develops a fibrous microstructure which remains essentially unchanged during the subsequent forming of the filament. The fibrous microstructure results in very ductile tungsten, but at the high temperatures of 2300° C. or more at which filaments are heated in lamps in order to produce light, this fibrous structure rapidly recrystallizes resulting in sagging and breaking of the filament. Accordingly, those skilled in the art know that after a tungsten filament has been formed it must be heated to recrystallize the tungsten at least to some degree in order to obtain a filament with a microstructure having characteristics satisfactory enough for use as a filament. In making tungsten filaments, the tungsten filament wire is first wound around a molybdenum, steel or other wire mandrel, called a primary mandrel, to form a coiled structure. A single coil type of filament is used in many types of incandescent lamps. However, in the more efficient miniaturized and high output lamps the tungsten filament is in the form of a double coil or a coiled-coil. In making this type of filament, the tungsten filament wire is first wound around a primary mandrel to form the first coil, with the so-formed coil structure then wound around a secondary mandrel to form the secondary coil. After the filament has been completely formed and annealed to minimize elastic springback after subsequent mandrel dissolve, it is removed from the secondary mandrel and placed in an acid bath containing acid such as a mixture of nitric and sulphuric acids and water which is well known to those skilled in the art and is disclosed, for example, in U.S. Pat. No. 4,440,729. This is done to dissolve away the primary (and secondary) mandrel to yield the final filament.

Figure 3:
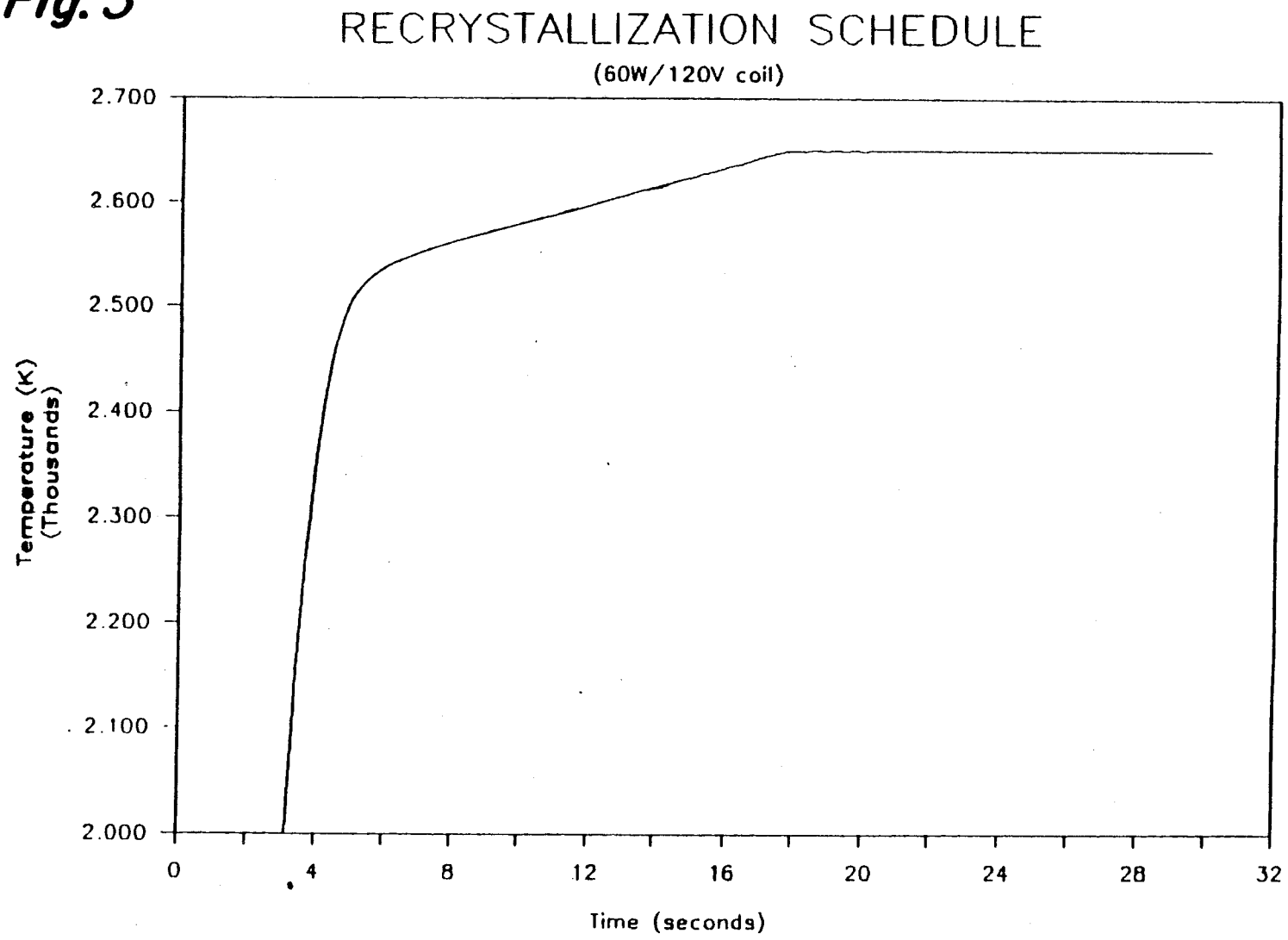
FIG. 3 is a time-temperature graph of a single anneal process used to anneal filaments and obtain the grain structure according to the invention.

In the continuous annealing method of this invention, a coiled-coil filament is processed with a recrystallization time-temperature schedule consisting of about 30 seconds with about 2650° K. maximum temperature, followed by rapid cooling to room temperature. A typical recrystallization schedule for 60 W, 120 V filaments is shown in FIG. 3 and has been successfully employed with this method to produce coiled-coil filaments suitable for 60 W, 120 V, miniature lamps having the properties of this invention. The specific time-temperature curve in FIG. 3 is representative of typical recrystallization processes which achieve 85% minimum recrystallization, but does not exclude other time-temperature treatments such as shorter times with higher maximum temperatures or longer times with lower maximum temperatures.

A preferred method for heating the filament employs a tungsten mandrel inside the center of the filament which is heated by passing electrical current through it, thereby indirectly heating the filament. A tungsten mandrel is placed inside the center of the filament and attached to electrodes which are then energized to heat the mandrel with filament. The tungsten mandrel is slightly smaller than the secondary mandrel used to form the coiled-coil, typically 1.0 mil smaller in diameter than the secondary mandrel. The heating is performed in a reducing atmosphere, such as forming gas consisting of 90% nitrogen and 10% hydrogen. Filament distortion, such as non-uniform secondary pitch or the spacing between adjacent secondary turns, is minimized if the molybdenum primary mandrel is present in the coiled-coil filament during the recrystallization heating treatment. A preferred process for the continuous annealing recrystallization method starts with a conventionally-processed coiled-coil, including first coiling on a molybdenum primary mandrel, annealing, second coiling and annealing, but not including acid dissolving of the primary mandrel. After recrystallizing the filament on a tungsten mandrel heated with electric current to produce the filament time-temperature curve in FIG. 3, the molybdenum primary mandrel is then dissolved with the standard acid process. Significant interdiffusion between the tungsten filament wire and molybdenum primary mandrel occurs during the recrystallization time-temperature treatment shown in FIG. 3, such that after dissolving the molybdenum mandrel in acid the tungsten filaments typically contain 500 to 3000 ppm total molybdenum concentration by weight. 60 W, 120 V, filaments typically contain 1000 to 2500 ppm molybdenum after recrystallization with a time-temperature treatment such as shown in FIG. 3 and subsequently dissolving the molybdenum primary mandrel. It should be noted that one does not have to leave the primary mandrel in the filament during recrystallization.

Alternatively, the recrystallization heating schedule such as shown in FIG. 3 could be performed by any other method to achieve the specified time-temperature treatment, such as placing the filament in a small tungsten boat and using a rapid-response furnace or attaching lead wires to the filament and directly heating the filament with an applied electrical current.

By way of an illustrative, but non-limiting example of the continuous anneal recrystallization method of this invention, 60 W, 120 V, coiled-coil filaments with 2.1 mil wire diameter, 60 mil outside diameter, 9.6 mm coil length and with the molybdenum primary mandrel present were loaded on a 31.0 mil tungsten mandrel attached to a programmable electric current source and heated in 90% nitrogen, 10% hydrogen to achieve the time-temperature schedule shown in FIG. 3, followed by rapid cooling to room temperature. The filaments were then placed in an acid bath to dissolve the molybdenum primary mandrel. The processed filaments were 95% recrystallized, contained 1700 ppm molybdenum by weight and microstructural analysis of 28 filaments produced the following average results:

GSP:56
GAR:240
GBF:4.3

The amount of recrystallization was determined by a coil stretch test which measures the difference in the springback properties of the tungsten. These properties are controlled by the elastic-plastic stress-strain behavior changes (such as yield strength and strain hardening rate) and is reflected in different springback properties. The coil stretch test consists basically of pulling the coil axially to a fixed stretch length of about 8 times the original length, releasing the tension and measuring the relaxed length. The percent recrystallization can then be calculated from the relaxed length resulting after stretching and two reference relaxed lengths, one for 0% recrystallization and one for 100% recrystallization. The reference coils are stretched to the same fixed stretch length. The 0% recrystallized reference filament has been processed through standard coiling treatments (first coiling, annealing, second coiling, annealing and acid dissolving of mandrel), but has not been heated in any subsequent recrystallization treatments. The 100% recrystallized reference filament has been processed with a high temperature treatment to assure 100% recrystallization. For a fixed treatment time, the temperature is high enough to define a 100% recrystallized reference when filaments processed to successively higher temperatures produce no significant increase in the relaxed length after stretch testing. Stretch tests are performed after recrystallization and subsequent mandrel dissolving. Typically the relaxed length increases less than 0.02% per K increase in temperature for recrystallization treatments defined as 100% recrystallized. The equation to compute percent recrystallization is:

$$\textit{percent recrystallization} = 100(l - l_o)/(l_1 - l_o)$$

where l is the relaxed length of the filament after stretching to a constant stretch length, $l_o$ is the relaxed length of the 0% recrystallized reference filament after stretching to the same constant stretch length and $l_1$ is the relaxed length of the 100% recrystallized reference filament after stretching to the same constant stretch length. The correlation between the stretch test and the conventional tedious metallographic procedure employing many polished and etched sections is good. This coil stretch test method has been published by Pugh and McWhorter as "An Elastic Recovery Test for Recrystallization," Metall. Trans. vol. 20A, pp. 1885-1887 (Sept. 1989), the disclosures of which are incorporated herein by reference.

In the two-stage heating or annealing treatment of this invention, the unrecrystallized filaments were heated in a forming gas atmosphere to a temperature broadly ranging between 1250°-2050° C. and preferably 1650°-2050° C. for about 7 minutes for the first stage. The molybdenum primary mandrel was dissolved away prior to the first stage anneal and heating was accomplished by resistive heating with lead wires attached to the filaments. This first stage annealing resulted in from about 5 to 73% recrystallization, depending on the temperature, with the higher temperatures being preferred.

After the first anneal, the partially recrystallized filaments were briefly cooled to room temperature and then rapidly heated again using a conventional pulsed resistive heating or flashing technique pulsing temperatures starting at 2200° K. up to 3200° K. over a period of about twenty seconds. Double coiled filaments made with this method for 45 watt (120 V) tungsten halogen lamps exhibited essentially about 100% recrystallization and virtually no sag when the first anneal was accomplished in the 1650°-2050° C. range. These filaments were coiled-coil filaments about 12 mm long from 0.06 mm diameter wire doped with potassium (GE 218 grade). Filaments have been made in this manner having a GSP of 86, a GBF of 4.4 and a GAR of 289. Filaments having similar properties according to the invention have also been made by heating in tungsten boats in a conventional furnace in a forming gas atmosphere.

In contrast to the filaments of this invention, filaments of similar construction taken from competitive tungsten halogen lamps made by another manufacturer exhibited a GAR of from about 12 to 22 and a GSP of from about 0.5 to 4.3.

Most of the filaments made according to this invention were made from a standard grade of tungsten filament wire made and available from GE Lighting located at Tungsten Road in Cleveland, Ohio, and designated as their GE Type 218 wire. This wire has a purity of 99.95+% W and is doped with potassium ranging from 65-80 ppm. Filaments having characteristics according to this invention have also been made from tungsten filament wire obtained from competitive wire manufacturers, both in the U.S. and Japan.

Figure 4A:
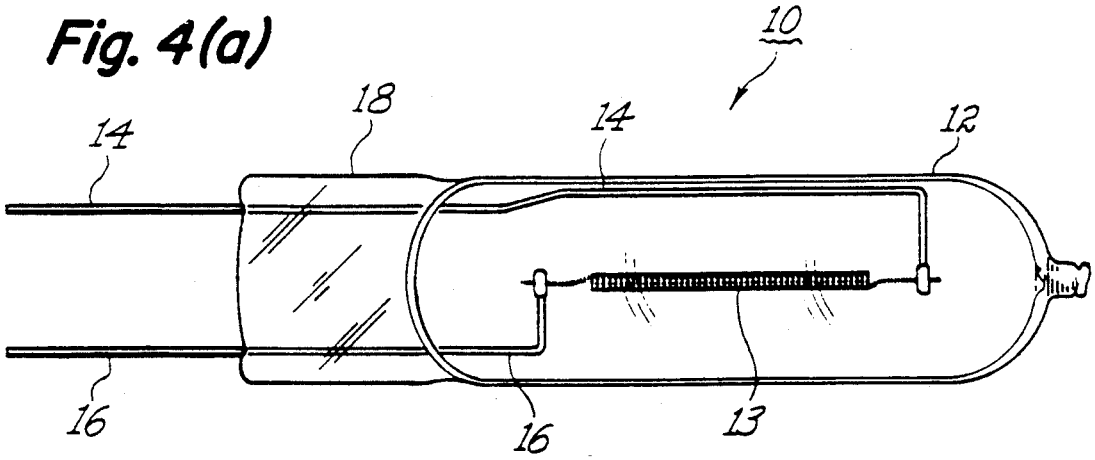
FIGS. 4(*a*), 4(*b*), and 4(*c*) schematically illustrates single and double ended incandescent lamps each having a filament according to the present invention.
Figure 4B:
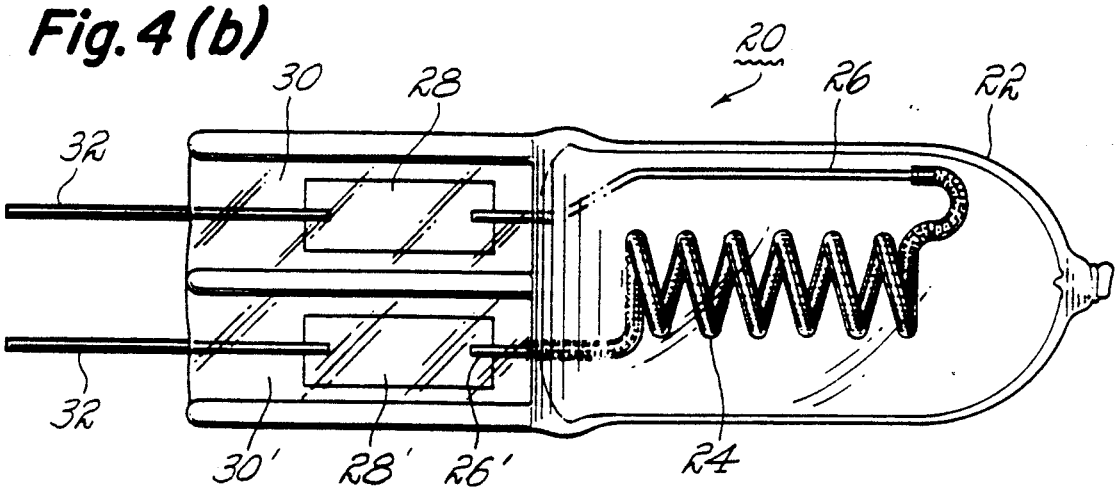
Figure 4C:
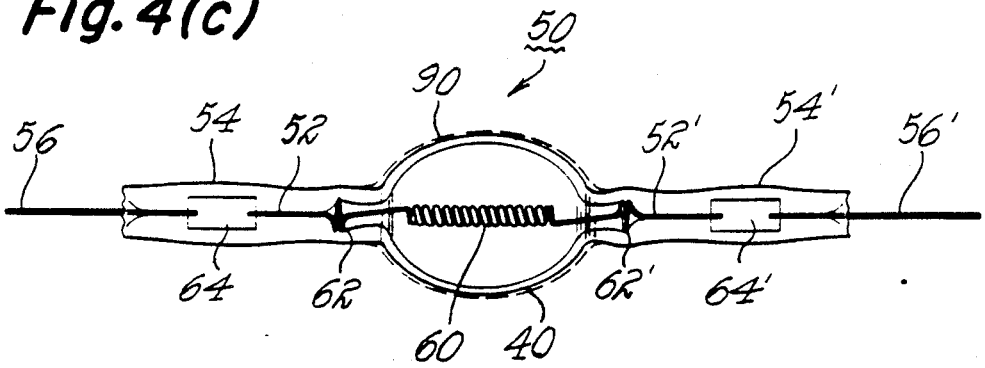

FIG. 4 schematically illustrates various types of lamps containing filaments according to the present invention. Thus, referring to FIG. 4(*a*), lamp 10 has a tubular envelope made of a suitable light transmissive vitreous envelope 12 formed from a high temperature aluminosilicate glass which may be of the type disclosed and claimed in U.S. Pat. No. 4,737,685 the disclosures of which are incorporated herein by reference. A coiled-coil tungsten filament 13 having properties according to the present invention is connected to and supported within said vitreous envelope by inlead wires 14 and 16 made of molybdenum and which extend through a customary pinch seal 18. If desired, molybdenum inleads 14 and 16 can be connected by means of welding, brazing or other suitable means to less costly metals of a greater or the same diameter to provide electrical connection for the filament and support for the lamp. Envelope 12 may also contain a fill comprising a mixture of nitrogen, hydrogen, noble gas, phosphorus, and a hydrogen such as chlorine and bromine.

FIG. 4(*b*) illustrates another type of lamp useful in the practice of this invention wherein molybdenum foil is used to effect a hermetic seal in the pinch seal area, as is the practice with such lamps having quartz envelopes. Thus, lamp 20 comprises quartz envelope 22 containing two pinch-sealed inlead constructions comprising outer terminal leads 32 and 32' and inner terminal leads 26 and 26' connected to opposite ends of intermediate molybdenum sealing foils 28 and 28', respectively. A compact coiled-coil tungsten filament 24 made according to the invention is attached at one end to inner lead 26 and at the other end to inner lead 26'. The leads are connected to the molybdenum sealing foils by suitable means, such as welding. Leads 26 and 26' are made of molybdenum. Envelope 22 also contains a fill comprising a mixture of noble gas, hydrogen, a getter such as phosphorus, and a halogen such as chlorine, bromine and optionally, nitrogen.

FIG. 4(*c*) illustrates a double-ended miniature lamp 50 comprising a light transmissive, fused silica (quartz) envelope portion 40 containing a coiled-coil tungsten filament 60 according to the present invention welded at each end to filament spuds 62 and 62' wherein both tubular end portions 54 and 54' have been shrink sealed over foil members 64 and 64' to form a hermetic seal and then cut to reduce their length to that desired. Outer leads 56 and 56' extend past the end of tube portions 54 and 54' which are cut to the desired length after assembly of the lamp. Shrink seals are preferred because deformation and misalignment of the tube portions of the lamp envelope are minimal as compared with that which can occur with pinch sealing. Shrink seals are known to those skilled in the art and examples of how to obtain same are found, for example, in U.S. Pat. Nos. 4,389,201 and 4,810,932. Lamps of this construction are commercially available and are disclosed, for example, in copending Ser. No. 349,282 filed on May 9, 1989.

Figure 5:
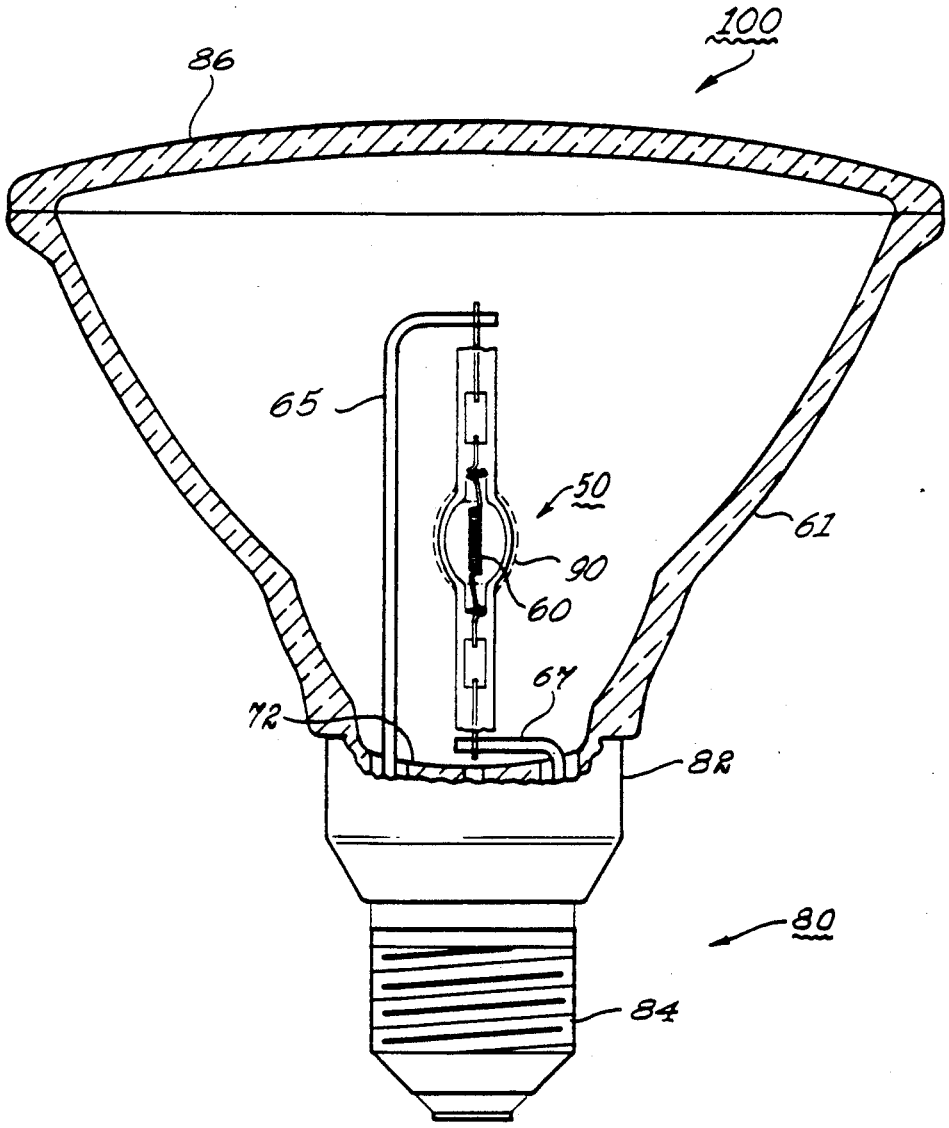
FIG. 5 schematically illustrates a combination double ended tungsten halogen lamp having a filament of the present invention, IR filter and a parabolic reflector.

Lamp 50 is shown assembled into a parabolic reflector 61 illustrated in FIG. 5. Thus, turning to FIG. 5, combination 100 contains lamp 50 mounted into the bottom portion of parabolic glass reflector 61 by means of conductive mounting legs 65 and 67 which project through seals (not shown) at the bottom portion 72 of glass reflector 61. Lamp base 80 is crimped onto the bottom portion of the glass reflector by means not shown at neck portion 82. Screw base 84 is a standard screw base for screwing the completed assembly 60 into a suitable socket. Glass or plastic lens or cover 86 is attached or hermetically sealed by adhesive or other suitable means to the other end of reflector 61 to complete the lamp assembly. Lamp 50 is also shown having coating 90 on the exterior surface of the lamp envelope for selectively reflecting infrared energy emitted by the filament back to the filament wherein at least a portion of the infrared radiation is converted to visible light.

The coating 50 is preferably made up of alternating layers of a low refractory index material such as silica and a high refractory index material such as tantala, titania, niobia and the like for selectively reflecting and transmitting different portions of the electromagnetic spectrum emitted by the filament. In a preferred embodiment of the invention the filter will reflect infrared radiation back to the filament and transmit the visible portion of the spectrum. Such filters and their use as coatings for lamps may be found, for example, in U.S. Pat. Nos. 4,229,066 and 4,587,923 the disclosures of which are incorporated herein by reference.

What is claimed is:

1. A coiled tungsten filament having a microstructure comprising an elongated and interlocking grain structure having a grain shape parameter of at least about 10.

2. The filament of claim 1 having a grain aspect ratio of at least about 50.

3. The filament of claim 1 having a grain aspect ratio of at least about 100.

4. The filament of claim 1 having a grain aspect ratio of at least about 200.

5. The filament of claim 1 having a grain boundary factor no greater than about 15.

6. The filament of claim 1 having a grain boundary factor no greater than about 8.

7. The filament of claim 1 being at least about 85% recrystallized.

8. The filament of claim 1 being at least about 95% recrystallized.

9. The filament of claim 1 containing at least about 500 ppm of molybdenum.

10. The filament of claim 1 having a grain boundary factor no greater than about 8, a grain aspect ratio of at least about 100 and being at least about 85% recrystallized.

11. The filament of claim 1 having a grain shape parameter of at least about 15.

12. The filament of claim 11 having a grain aspect ratio of at least about 50.

13. The filament of claim 11 having a grain aspect ratio of at least about 100.

14. The filament of claim 11 having a grain aspect ratio of at least about 200.

15. The filament of claim 11 having a grain boundary factor no greater than about 15.

16. The filament of claim 11 having a grain boundary factor no greater than about 8.

17. The filament of claim 11 being at least about 85% recrystallized.

18. The filament of claim 11 being at least about 95% recrystallized.

19. The filament of claim 11 also containing at least about 500 ppm molybdenum.

20. The filament of claim 11 having a grain boundary factor no greater than about 8, being at least about 85% recrystallized and having a grain aspect ratio of at least about 100.

21. The filament of claim 20 containing at least about 500 ppm of molybdenum.

22. The filament of claim 20 being at least about 95% recrystallized.

23. The filament of claim 22 having a grain aspect ratio of at least about 200.

24. The filament of claim 10 containing at least about 500 ppm of molybdenum.

25. A coiled tungsten filament having an elongated and interlocking grain microstructure which has a grain aspect ratio of at least about 50.

26. The filament of claim 25 having a grain aspect ratio of at least about 100.

27. The filament of claim 25 having a grain aspect ratio of at least about 200.

28. The filament of claim 25 having at least about 500 ppm molybdenum.

29. The filament of claim 27 having at least about 500 ppm molybdenum.

30. The filament of claim 27 having at least about 500 ppm molybdenum.

31. The filament of claim 27 being at least about 85% recrystallized.

32. An incandescent electric lamp comprising a hermetically sealed, light transmissive envelope enclosing a coiled tungsten filament within, said filament having an elongated and interlocking grain microstructure having a grain shape parameter of at least about 10.

33. The lamp of claim 32 wherein said light transmissive envelope is a vitreous envelope.

34. The lamp of claim 32 wherein said filament has a grain aspect ratio of at least about 50.

35. The lamp of claim 32 wherein said filament has a grain aspect ratio of at least about 100.

36. The lamp of claim 32 wherein said grain shape parameter is at least about 15.

37. The lamp of claim 32 wherein said filament is at least about 85% recrystallized.

38. The lamp of claim 32 wherein said filament has a grain boundary factor no greater than about 15.

39. The lamp of claim 32 wherein said filament has a grain boundary factor no greater than about 8.

40. The lamp of claim 32 wherein said filament contains at least about 500 ppm molybdenum.

41. The lamp of claim 33 containing on said vitreous envelope a coating for selectively reflecting and transmitting selected portions of the light spectrum emitted by said filament.

42. A tungsten halogen lamp comprising a hermetically sealed, vitreous, light transmissive envelope having a filament chamber enclosing within a coiled tungsten filament and a fill comprising one or more halogens, wherein said filament has an elongated and interlocking grain microstructure having a grain shape parameter of at least about 10.

43. The lamp of claim 42 wherein said filament chamber further contains a coating on the surface thereof for selectively reflecting and transmitting various portions of the light spectrum emitted by said filament.

44. The lamp of claim 42 wherein said filament has a grain aspect ratio of at least about 50.

45. The lamp of claim 43 wherein said filament has a grain aspect ratio of at least about 50.

46. The lamp of claim 42 wherein said filament has a grain aspect ratio of at least about 100.

47. The lamp of claim 43 wherein said filament has a grain aspect ratio of at least about 100.

48. The lamp of claim 42 wherein said filament has a grain boundary factor no greater than about 15.

49. The lamp of claim 43 wherein said filament has a grain shape parameter of at least about 15.

50. The lamp of claim 42 wherein said filament has a grain boundary factor no greater than about 8.

51. The lamp of claim 42 wherein said filament has a grain boundary factor no greater than about 8.

52. The lamp of claim 42 wherein said filament has a grain boundary factor no greater than about 8 and a grain shape parameter of at least about 15.

53. The lamp of claim 42 wherein said filament grain shape parameter is at least about 15 and said filament is at least about 85% recrystallized.

54. The lamp of claim 43 wherein said filament grain shape parameter is at least about 15 and said filament is at least about 85% recrystallized.

55. The lamp of claim 53 wherein said filament contains at least about 500 ppm of molybdenum.

56. The lamp of claim 54 wherein said filament contains at least about 500 ppm of molybdenum.

57. A tungsten halogen lamp comprising a hermetically sealed, vitreous, light transmissive envelope having a filament chamber enclosing within a coiled tungsten filament and a fill comprising one or more halogens, wherein said filament has an elongated and interlocking grain microstructure having a grain shape parameter of at least about 10 and wherein said filament chamber contains a thin film optical interference coating on the outside surface thereof for reflecting infrared radiation and transmitting visible light radiation emitted by said filament, and further, wherein said filament is at least about 85% recrystallized, has a grain aspect ratio of at least about 100 and a grain boundary factor no greater than about 15.

58. The lamp of claim 57 wherein said grain shape parameter is at least about 15.

59. The lamp of claim 58 wherein said grain boundary factor is no greater than about 8.

60. The lamp of claim 59 wherein said filament contains at least about 500 ppm of molybdenum.

61. The lamp of claim 57 wherein said filament contains at least about 500 ppm of molybdenum.

62. The lamp of claim 60 being a miniature lamp.

63. The lamp of claim 57 being a miniature lamp.

64. The lamp of claim 60 being a double ended lamp.

* * * * *